US005685690A

United States Patent [19]

Wagner et al.

[11] Patent Number: 5,685,690

[45] Date of Patent: Nov. 11, 1997

[54] AUTOMATIC SHEET DISPENSING MECHANISM FOR HAND-FED PATTY MACHINE

[75] Inventors: Richard C. Wagner, Frankfort; Ronald R. Davis, Lockport, both of Ill.

[73] Assignee: Hollymatic Corporation, Countryside, Ill.

[21] Appl. No.: 652,281

[22] Filed: May 22, 1996

[51] Int. Cl.[6] ..... B65G 59/06

[52] U.S. Cl. ..... 414/797.7; 414/789.5; 414/795.7; 414/797.9

[58] Field of Search ..... 414/789.5, 795.7, 414/797.7; 271/10.11, 119, 239, 245

[56] References Cited

U.S. PATENT DOCUMENTS

| | | | |
|---|---|---|---|
| 3,424,294 | 1/1969 | Felstehausen | 414/789.5 |
| 3,506,258 | 4/1970 | Lindquist . | |
| 3,589,711 | 6/1971 | Holly . | |
| 3,959,951 | 6/1976 | Paules | 414/789.5 |
| 4,193,590 | 3/1980 | Mongagnino . | |
| 4,216,952 | 8/1980 | McInerny . | |
| 4,529,187 | 7/1985 | Einem et al. . | |
| 4,557,472 | 12/1985 | Hannon | 414/797.7 |
| 4,715,593 | 12/1987 | Godlewski . | |
| 5,006,042 | 4/1991 | Park | 414/797.7 |
| 5,098,078 | 3/1992 | Nakanishi . | |
| 5,137,172 | 8/1992 | Wagner et al. . | |
| 5,184,811 | 2/1993 | Sardella et al. | 271/10.11 |
| 5,423,526 | 6/1995 | Hasegawa . | |
| 5,562,402 | 10/1996 | Muto | 414/797.7 |

*Primary Examiner*—Karen B. Merritt
*Assistant Examiner*—Douglas Hess
*Attorney, Agent, or Firm*—Sughrue,Mion,Zinn,Macpeak & Seas, PLLC

[57] ABSTRACT

A sheet dispensing mechanism employs an open bottom sheet dispenser positioned beside a molding device, molding articles which are cyclically ejected and driven vertically downwardly along an article ejection path, with the bottom sheet shingling out against an oblique baffle. A pair of rotatable indexing rollers with a high coefficient friction member on the periphery of each roller penetrate the open bottom of the dispenser to press the single sheets against the baffle, thereby allowing the indexing rollers to frictionally drive only the end sheet in the direction of the path. A spring biased articulated nip roller assembly downstream of the dispenser accelerates the indexed sheet to intersect the ejection path of the article simultaneously with ejection of the article. A proximity switch senses the arrival of the food portion at the article ejection station to initiate one cycle rotation of the indexing rollers to index the bottom-most sheet of the stack.

11 Claims, 3 Drawing Sheets

AUTOMATIC SHEET DISPENSING MECHANISM FOR HAND-FED PATTY MACHINE

FIELD OF THE INVENTION

This invention relates to hand-fed patty machines for forming sequentially meat patties or like food portions which are dispensed vertically and to dispensing from a stack, coated paper sheets interleaved between the meat patties.

BACKGROUND OF THE INVENTION

Over the years, there has developed apparatuses for forming patties of food materials such as ground meat, with the patties being substantially uniform in size, shape and weight, with their production highly sanitary compared to hand forming of patties.

U.S. Pat. No. 4,302,868 to Wagner and U.S. Pat. No. 4,597,134 to Wagner, assigned to the common assignee are representative of such apparatus.

Thin sheets of waxed paper or the like slightly oversized to that of the patties have been fed from a stack within a hopper or dispenser to one side of the patty machine for movement into the path of the patties as they are formed and discharged into a vertical stack interleaved by the coated paper sheets.

U.S. Pat. No. 5,137,172 to Wagner and Azzar is representative of a paper feed system utilizing such paper hopper or dispenser. The hopper includes a pair of guides along opposed vertical sidewalls in the form of male members extending inwardly from opposed sidewalls with an end adjacent to the bottom of the hopper or dispenser which are thicker than the remainder of the guides. The deformable elements cooperate with the guides so that the paper is deformed but not torn when the sheets are dispensed one after the other from the bottom of the hopper. A reciprocating conveyor moves the sheets sequentially, with the paper being bent at an extreme angle when pulled free from the guides without tearing the bottom-most individual sheet as it is dispensed laterally from the hopper in the direction of the food portion path. Further, the two vertical guides on the opposite sidewalls of the hopper terminate at their lower ends in sloped segments causing the lower-most sheets to feather or shingle forwardly in the direction of sheet transport from the hopper or dispenser for movement through a gap in the front wall in the direction of the food portion path. The front wall of the hopper or dispenser is likewise provided with a downwardly and forwardly oblique portion to facilitate such shingling or feathering. The angled area where the paper sheets are feathered known as a "lock area" or "lock zone" allows the hopper or dispenser to be run with a smaller stack of paper without missing a paper feed on strokes occurring when the paper does not fill the lock area.

The sequential feeding of the thin coated sheets is ensured since those sheets within the lock zone are isolated from the weight of the sheets which lie offset and above the lock area.

While the paper feed system of U.S. Pat. No. 5,137,172 through the interaction of the guides and the conforming notches to opposite sides of the coated paper sheets causes a sufficiently large hold-back force such that only the bottom-most sheet of paper encounters the pulling force of the reciprocating conveyor to prevent feeding of more than one sheet at a time, the system is not completely satisfactory for high speed operation of the sheet feeding system, nor is sheet feeding adequately synchronized with the patty forming and discharging operation of the patty machine to which it has application.

It is therefore an object of the present invention to provide an improved automatic sheet dispensing mechanism for a meat patty making machine in which the sheets of coated paper such as thin flexible waxed paper are subjected sequentially to an upward force developed on the bottom-most sheet opposed by an inclined baffle overlying the shingle sheets which project outwardly in the forward feed direction from the vertical stack of sheets to significantly reduce the influence of the changing height of the stack and the resulting weight of the paper stack relative to an indexing force applied to the lower-most sheet.

It is a further object of the invention to provide an automatic feed dispensing mechanism, which is synchronized with the patty making machine, which is compact, which ensures separation of the lower-most sheet after indexing from the balance of the stack, which accelerates and separates the indexed sheets and which correctly positions the indexed sheet in the path of the formed and discharged patty and which may be commonly powered by the motor operating the patty forming machine.

Numerous advantages and features of the present invention will be apparent from the following detailed description of a preferred embodiment of the invention, the accompanying drawings and the claims appended thereto.

DETAILED DESCRIPTION OF THE PREFERRED EMBODIMENT

Figure 1:
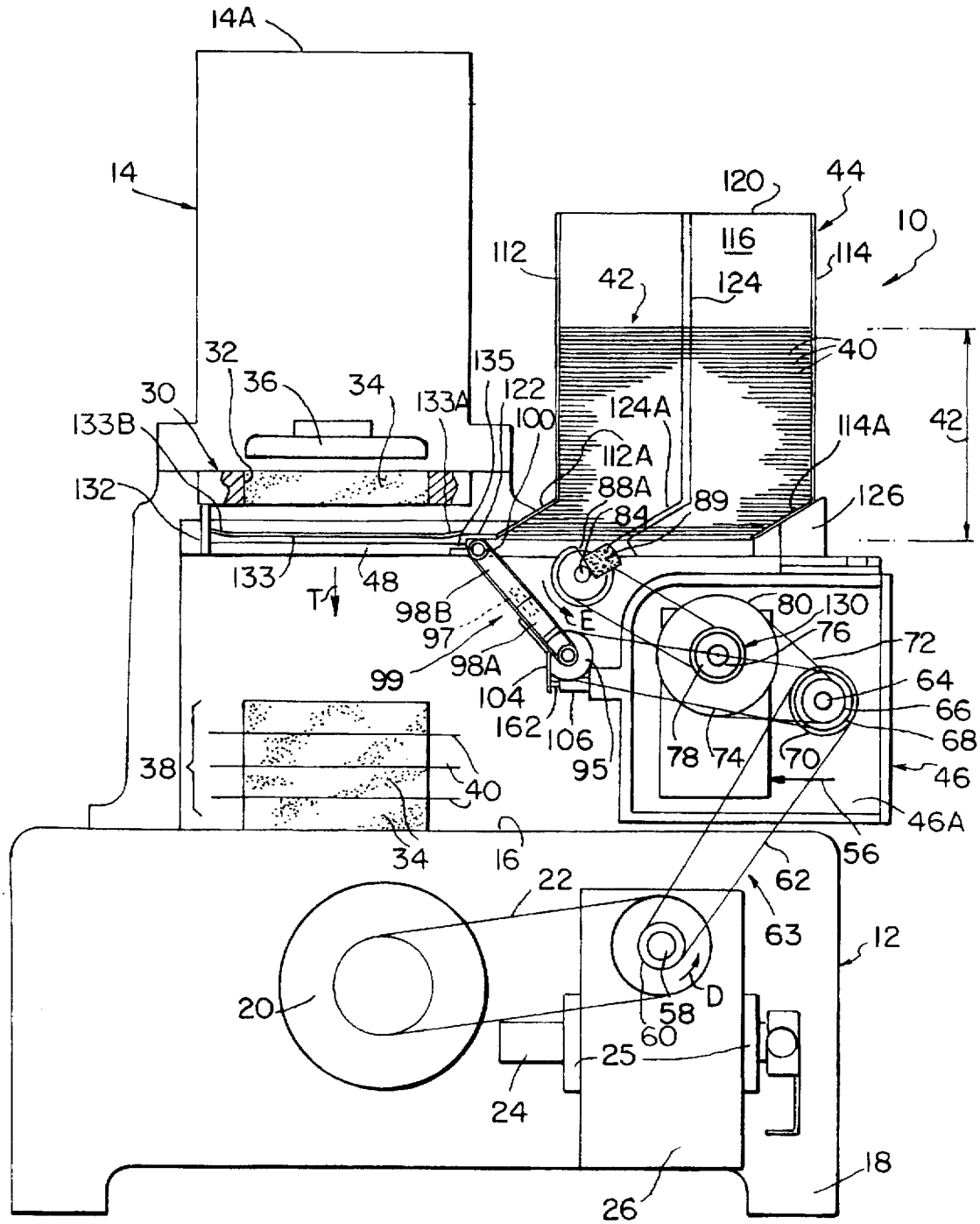
FIG. 1 is a schematic side elevational view, partially broken away of the automatic feed dispensing mechanism for use with a meat patty forming machine forming a preferred embodiment of the invention.

A preferred embodiment of the invention is illustrated in the drawing figures, however, it is one example of an automatic sheet dispensing mechanism employing the principles of the invention and the invention is not intended to be limited to the illustrated embodiment.

Figure 2:
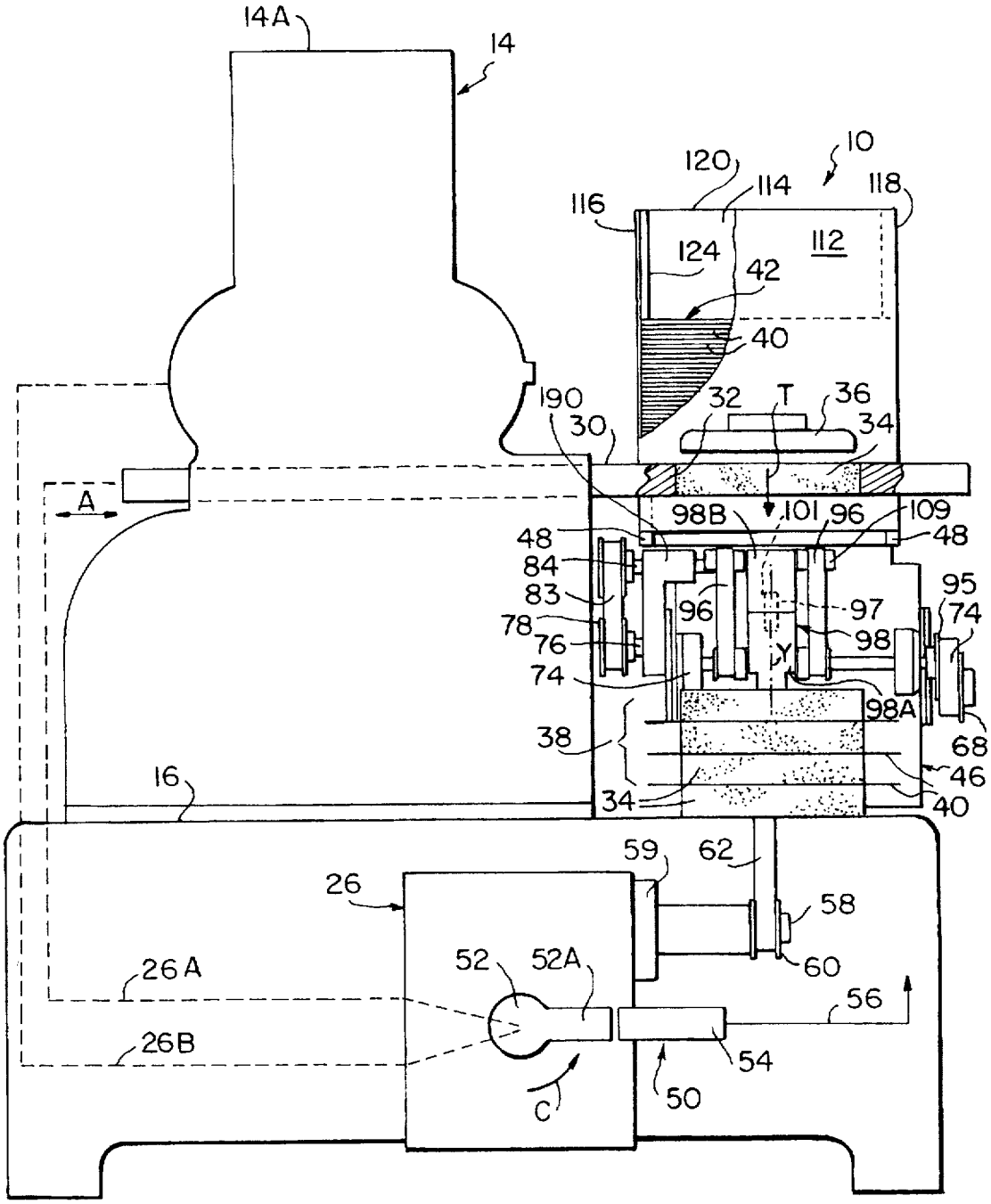
FIG. 2 is a schematic, front elevational view of the mechanism of FIG. 1.
Figure 3:
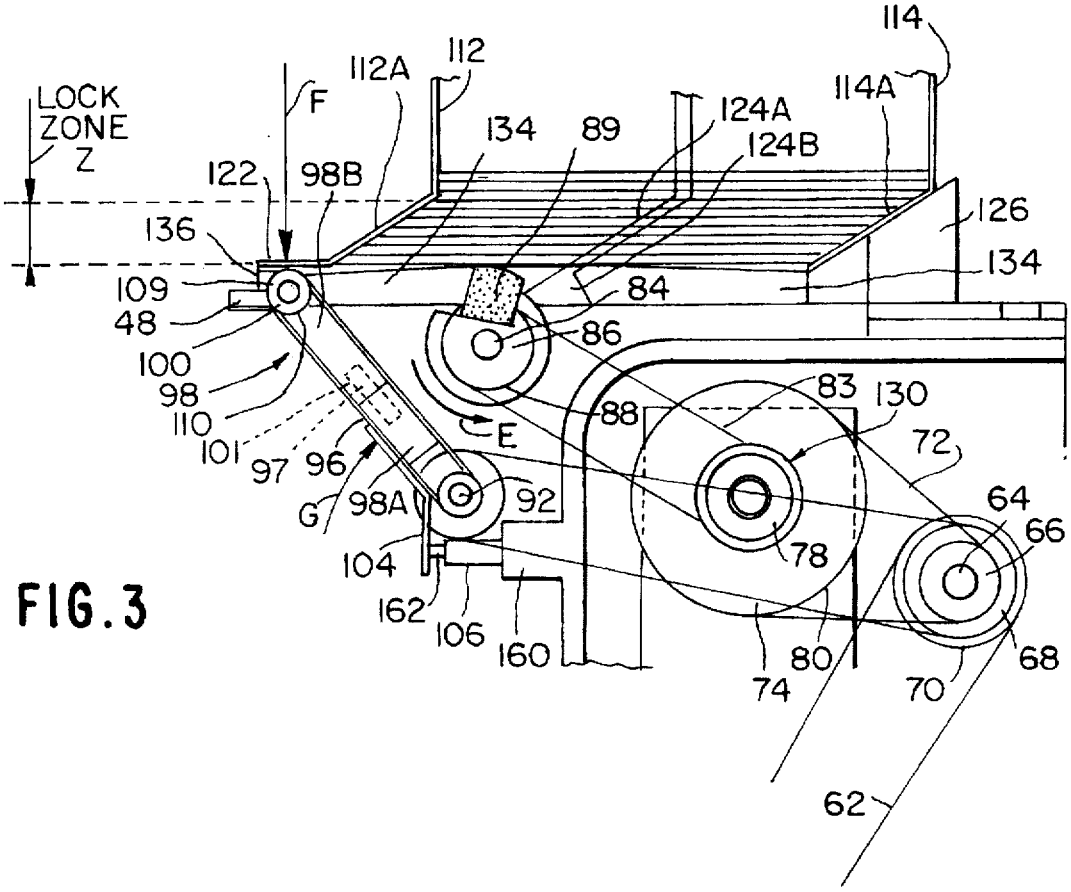
FIG. 3 is an enlarged side elevational view of the sheet indexing assembly forming a principal component of the automatic sheet dispensing mechanism of FIG. 1.

Drawing FIGS. 1, 2 and 3 illustrate a preferred embodiment of the invention, constituting an automatic feed dispensing mechanism indicated generally at 10, commonly mounted on a rectangular base 12 with a hand-fed patty forming machine 14 in side-by-side position as seen best in FIG. 2. The hand-fed patty forming machine 14 is positioned on a horizontal platform 16 constituting the top of base 12 to the left of the automatic sheet dispensing mechanism 10. The base 12 which may be formed of cast or sheet metal which mounts upright on a floor or the like via legs 18. It houses, preferably internally, a motor 20 which functions to power the hand fed patty forming machine 14 and which is commonly coupled by belt 22 to an input shaft 58 of transmission 26. While the embodiment of the invention has been shown as employed with and integrated to a hand fed patty forming machine 14, such as those of Wagner U.S. Pat. Nos. 4,302,868 and 4,597,134, the automatic sheet dispensing mechanism 10 of this invention has application to other patty making apparatuses. The hand fed patty forming machine 14 is shown schematically as including a laterally reciprocating mold plate 30 which reciprocates horizontally as indicated by double headed arrow A, FIG. 2, which includes an opening or mold cavity 32 within which is formed a meat patty or other food portion 34. The patty 34 is ejected downwardly by a knockout cup 36 as indicated by arrow T, FIG. 2, so that a stack of food portions or meat patties 38 may be formed on platform 16 along a vertical path as defined by arrow T.

The function of the automatic sheet dispensing mechanism 10 is to interpose sequentially an initially indexed and accelerated sheet 40 from the bottom of a stack of coated paper sheets 42 within a dispenser indicated generally at 44. Typically, in such hand feed patty forming machine 14, a machine operator periodically drops a mass of ground beef, hamburger or like meat into the open top 14A of the machine 14, with the mold plate 30 oscillated to move a food portion or patty 34 within the mold cavity 32 outwardly of the machine 14 and underneath a vertically reciprocatable knockout cup 36 sized to the mold plate cavity 32 to force the food portion or patty 34 from the cavity to drop onto the surface or platform 16. In dropping, the food portion or patty 34 impacts against the upper surface of an indexed coated paper sheet 40, FIG. 1, forcing the indexed and laterally projected, lower-most sheet 40 when positioned in the path T of the knockout patty 34 downwardly in the direction of the underlying platform 16 of base 12. The lower-most patty 34 of the stack 38 may rest directly on platform 16, although it is preferred that a coated paper sheet 40 underlie the same. As such, the stack 38 of food portions 38 or patties 34 are interleaved with the coated paper sheets 40.

As may be appreciated, FIG. 2, transmission 26 serves to power both the hand fed patty forming machine 14 including meat compressing means (not shown) and the drive 26A for reciprocating the mold plate 30. The electrical motor 20 is coupled to the transmission 26 by way of a belt 22. The transmission 26 has a low speed output shaft 24 which rotates, in this embodiment, at a controlled 36 rpm. The output shaft 24 supported by bearings 25 connects at one end to the motorized components of the patty forming machine 14 and at an opposite end which rotates once every cycle of rotation of shaft 24 into a position of alignment with a solid state proximity switch 54. The solid state proximity switch 54 changes state momentarily upon alignment of the rotating member arm 52A, with the proximity switch 54 sending an electrical pulse through line 56 to a single revolution clutch indicated generally at 130, FIG. 1.

The transmission input shaft 58 is mounted via bearings 59, with shaft 58, in the illustrated embodiment, rotating at 1078 rpm. Shaft 58 carries a pulley 60 upon which it is leaved an automatic sheet dispensing mechanism drive belt 62.

Figure 4:
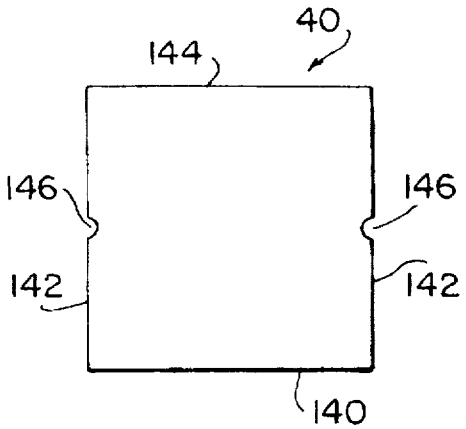
FIG. 4 is a top plan view of a coated paper sheet employed with the invention.

A sheet dispensing mechanism housing or frame 46 mounts to base 12 on platform 16 to the side of the patty forming machine 14. That housing or frame 46 is topped by a sheet dispenser or hopper 44 which is vertically upright on frame 46 and including a vertical front wall 112, a vertical rear wall 114 and laterally opposed vertical sidewalls 116, 118. The top of the dispenser 44 is open to permit insertion of a stack of paper sheets as at 42. The front wall 112 terminates at its lower end in a downwardly oblique front wall portion 112A which acts as a sheet baffle. Similarly, the rear wall 114 terminates in a downward and forward oblique extension 114A (in terms of the direction of sheet feeding, in sequence, of coated paper sheets 40). The dispenser 44 is similar in construction and operation to that of the paper hopper of U.S. Pat. No. 5,137,172. The dispenser 44 is fixedly mounted on frame or housing 46 at some distance above the platform 16 of base 12 by means of a triangular or trapezoidal form support 126 at the rear of the dispenser conforming to the inclination of the oblique portion 114A of rear wall 114. The dispenser 44 rests primarily on horizontally extending, laterally spaced rails 48 to form an elongated slot opening to the bottom of the dispenser 44 and extending forwardly in the direction of the coated paper sheets 40 intersecting the path T of movement of the formed patties or food portions 34 as they are knocked out of the mold cavity 32. The patties 34 are driven downwardly in the direction of platform 16 of base 12. The coated paper sheets 40 are sized to the dimensions of the dispenser 44. Further, similar to U.S. Pat. No. 5,137,172, vertical guides 124 extend downwardly along the interior surfaces of the laterally opposed sidewalls 116, 118. The guides 124 each terminate at their lower ends in forwardly and downwardly oblique portions 124A which in turn terminate in enlarged rearwardly flared terminal portions 124B functioning to hold back the lower-most coated paper sheets 40 interacting via the side notches 146, FIG. 4, within side edges 142 of the sheets 40 and intermediate of leading edge 140 and trailing edge 144 of each sheet. The structure of the bottom of the dispenser 44 and the inclination of front wall and rear wall portions 112A, 114A define a lock zone Z as per FIG. 3 much in the same manner as U.S. Pat. No. 5,137,172.

Unlike that patent, however, the automatic sheet dispensing mechanism 10 of the present invention eliminates the use of a horizontally reciprocating slide which fixedly engages the bottom surface of the lower-most sheet 40 of stack 42. The present invention employs a timed indexing of the bottom or lower-most sheet 40 via a rotary sheet indexing member, a further acceleration of that sheet 40 after separation from the stack 42 until the leading edge 140 of the sheet 40 impacts a paper stop 132. This occurs preferably at the exact moment that the knockout cup 36 knocks out a formed article, i.e., a food portion or patty 34 from mold cavity 32 under an arrangement prior to the thin flexible coated paper sheet 40 from sagging at its middle into an upwardly concave form. This thereby prevents a misalignment or failure of the sheets 40 to be properly interleaved between the formed patties 34 to effect a uniform stack 38 of such food portions on the platform 16. Such arrangement is in contrast to the prior practice as exemplified by U.S. Pat. No. 5,137,172, where mechanical synchronization is required between the mechanically driven components of the patty forming machine and the mechanically driven reciprocating sheet feeder of the paper feed system.

In this invention, the pair of guide rails 48 extend nearly the overall length of the machine 14 beneath the dispenser or hopper 44 and completely across the path of travel T of the meat patties 34 as indicated by arrows T, FIGS. 1 and 2. Extending transversely between opposed rails 48 is paper stop 132, with the paper stop 132 intersecting elongated grooves 133 within the opposing inside surfaces or faces of rails 48, through which the side edges 142 of the coated paper sheets pass respectively during transport from dispenser 44 to a position of alignment with the patty travel path or article ejection path T beneath mold plate 30. The guide rails 48 are spaced from each other a distance which is less than the width of the coated paper sheets 40. The guide grooves 133 are of a depth in excess of that width and are flared upwardly at opposite ends at 133A and 133B, respectively. At the entry end of the guide grooves 133, each rail 48 preferably includes a notch 135 below the path of travel of the sheets 40 in the direction of paper stop 132. A sheet 40 when driven to the extent of its leading edge 140 abutting the stop 132 is in a proper position to accept the meat patty or food portion 34. To prevent the sheet 40 from bouncing back and out of position, the pair of notches 135 at that point face the trailing edge 144 of the sheet such that when the edge 144 drops slightly due to the presence of the notches, rebound of the sheet 40 is stopped by the vertical wall portion of the notches 136.

Alternatively, the dispenser 44 may include an L-shaped bar which extends across the aperture or opening of the dispenser downstream of the articulated roller assembly such that each sheet when positioned in alignment with the meat patty 34 will be supported along both side edges by guide grooves 133 and at the rear or trailing edge by an L-shaped bar while permitting the thin flexible coated paper sheet to be driven downwardly in the direction of the travel path T of the meat patty 34 when knocked out of the mold plate cavity 32 by knockout ram 36.

The dispensing of the sheets sequentially from the open bottom of dispenser 44 is accomplished by a pulley and drive train indicated generally at 63 connected to input shaft 58 of the transmission 26, FIG. 1. The frame or housing 46 includes laterally opposed sidewalls 46A. Shaft 64 spans between the sidewalls 46A on bearings (not shown) and have fixedly mounted thereto three longitudinally spaced pulleys of increasing diameter at 66, 68 and 70. Pulley 70 carries belt 62, that at 68 carries belt 74, and that at 64 carries belt 72. Pulley 70 is sized relative to pulley 60 of transmission input shaft 58 such that shaft 64 is rotated at a speed of 718 rpm in the illustrated embodiment. Spanning between opposed sidewalls 46A of the frame or housing 46 is a further shaft 76 supported for rotation about its axis by bearings (not shown). This shaft 76 carries a relatively small diameter pulley 78 fixed thereto and longitudinally spaced therefrom a larger diameter pulley 80. The larger diameter pulley 80 is fixed to shaft 76, about which belt 72 is leaved and results in the shaft 76 being driven at a considerably reduced speed of 239 rpm in the illustrated embodiment.

A further shaft 84 extends from index arm 190, is mounted to the frame 46 and is positioned a short distance below the open bottom of the dispenser 44 in the vicinity of the lock zone Z and facing the feathered or shingled lower-most sheet 40 within that lock zone. Shaft 84 is mounted by bearings (not shown) for rotation horizontally about its axis and has fixed thereto a pulley 86 of a diameter corresponding to that of pulley 78 on shaft 76. A belt 83 extends between pulleys 78 and 86 such that the shaft 84 is driven at a speed commensurate with that of shaft 76. Also mounted on shaft 84 are a pair of longitudinally spaced indexing rollers 88, each having a flat or cutout at 88A on one side, from which projects radially a rotatable, high coefficient of friction material block 89 such as of 65 durometer rubber. The block 89 is of a thickness such that its outer periphery momentarily extends into the lock zone Z to index the lower-most sheet 40 from under the stack 42 of sheets.

In contacting the lower-most sheet, the block 89 forces the lower-most sheet 40 upward slightly to develop an adequate normal force to move the sheet 40 in the direction of rotation tangentially to the periphery of the rotatable indexing wheels 88. The enlarged terminal portion 124B of the guides 124 within the dispenser 44 acting on the side notches 146 of the coated paper sheets 40 act to prevent the sheet immediately above the lower-most sheet 40 to move out of the dispenser 44 with the indexed sheet. The force to release the sheets from the dispenser is larger than the force developed due to the coefficient of friction between the sheets 40 such that the high friction rotatable rubber material blocks move the lower-most sheet laterally out of the dispenser while the remaining sheets of stack 42 above the same stay in position. Since the outer periphery of the rotatable block 89 is radially beyond the periphery of the wheel 88 upon which it is mounted, a force is developed through the leading portions of the sheets 40 within the lock zone Z opposed by the inclined lower portion or section 112A of the front wall 112 of the dispenser 44, with that portion or section 112A acting as a baffle. The arrangement, therefore, ensures that there is an adequate hold-back force for all of the sheets with the exception of the one immediately in contact with the friction material block 89 and being indexed forwardly in the direction of the guide grooves 133 within opposed rails 48.

A further aspect of the present invention resides in the utilization of the articulated roller assembly 99 functioning to accelerate the speed of the indexed lower-most coated paper sheet 40 in the direction of travel through guide grooves 133 prior to impact of the leading edge thereof against the paper stop 132. In accomplishing that function, the invention requires the inclusion of a fixed, horizontal pressure plate 122 which may be separate from the dispenser 44 or constituted by an integral extension of baffle 112A. In the illustrated embodiment, the oblique terminal portion 112A of the front sidewall 112 of dispenser 44 is extended by a horizontal short length sheet metal portion to form the stationary pressure plate 122. The pressure plate 122 defines with a longitudinally spaced pair of nip rollers 100 of the articulated roller assembly 99 a passage through which the indexed lower-most coated paper sheet 40 travels from the dispenser 44 to a position of alignment with the meat patty travel path T.

The articulated roller assembly 99 is formed essentially by elements carried by a further transverse rotatable shaft 92 which extends between the opposed sides 46A of the frame or housing 46. The shafts 64, 76, 84 and 92 are horizontal and parallel to each other, with shaft 92 supported by bearings (not shown) at opposite ends within respective sidewalls 46A. Reference to FIG. 2 shows the mounting of an articulated arm 98 formed of split sections 98A and 98B. The radially innermost section 98A carries a transverse bore through which passes shaft 92 such that the arm 98 is freely rotatable about the bore and thus articulated on shaft 92. Shaft 92 carries additionally a pair of longitudinally spaced drive pulleys 94 of relatively small diameter about which are leaved respectively belts 96 which are supported at the opposite ends by respective pulleys 109. The pulleys 109 are mounted on a common shaft 100 which extends through respective pulleys 109, with the pulleys fixed thereto. The pulleys 109, in turn, are fixed to a pair of nip rollers 110, with the shaft 100 being supported by the radially outer section 98B of arm 98. Shaft 92, in addition to supporting the arm 98, carries a driven pulley 95 which is fixed to the shaft 92 for rotation counterclockwise, via belt 74, which is leaved at its opposite end about pulley 68 carried by shaft 64. As a result of the belt and pulley drive train, the nip rollers 110 are driven counterclockwise so as to accelerate the lower-most coated paper sheet 40 when the leading edge 140 thereof is driven into the nip between the nip rollers 110 and the stationary pressure plate 122.

The articulated roller assembly 99 has a number of additional features. The laterally spaced nip rollers 110 contact the lower-most sheet 40 of stack 42 and press that sheet against the stationary pressure plate 122 to effect accelerated driving of the indexed sheet into its position within guide grooves 133 so as to align the same beneath the meat patty or food portion 34 prior to knock-out of that portion 34 from the mold plate cavity 32. It is important that the drive forces developed by rotation of the nip rollers 110 are applied equally to respective sides of the coated paper sheet 40. To ensure such action, the arm 98 is split in two portions 98A and 98B which are coupled together by an articulation pin 97 at the longitudinal center of the arm. One end of the pin 97 may be fixedly mounted to one section 98A, while the opposite end of the articulation pin 97 may be received by a cylindrical bore as at 101 within the other section 98B. As such, the shaft 100 to which the nip rollers 110 are fixed may swivel about the longitudinal axis Y, FIG. 2, to prevent skewing of the coated paper sheet 40 as it is further driven by the articulated roller assembly 99 after leaving dispenser 44. Thus, this arrangement ensures substantially equal pressure on the sheet by respective nip rollers 110. Otherwise, pressure on one and not the other nip roller causes the sheet 40 to tend to move out at an angle instead of parallel to its longitudinal centerline. The nip rollers 110 are mounted on bearing shaft 100, which in turn is articulated by the articulation pin 97 to conform the peripheries of the nip rollers 110 to the surface of the pressure plate against which they are forced.

Such forces are developed by a spring loaded lever 104 which is fixed to the face of arm section 98A defined by shaft 92. The lever 104 is formed of two portions which are at an obtuse angle to each other, the lower portion of which extends downwardly from axle 92. The housing 46 includes a horizontal projection or mount 160 fixedly supporting a coil spring casing or tube 106 housing a projectable plunger 162, one end of which (not shown) abuts a coil spring (not shown) internally of the casing 106 such that the plunger is biased in the direction of the lever 104, thereby tending to rotate the articulated roller assembly arm 98 clockwise about the axis of shaft 92. The nip rollers 110 are biased by a small spring force such that the normal force at this point is small (about nine ounces), which is adequate to frictionally drive the sheet 40, but not excessive so as to cause undesirable wear of the nip rollers 110 when they are in contact directly with the bottom of the pressure plate 122 when the sheets 40 are not being dispensed.

The belt and pulley drive train causes the articulated nip rollers to be driven at 897 rpm. As a result, the rotatable high coefficient 8 friction block members 89 move the lowermost sheet of stack 42 to the point where its leading edge 140 is driven into the nip of a pair of belt driven nip rollers 110 with plate 122. The sheet 40 is driven between the rollers and the stationary pressure plate 122 at a velocity of approximately 22 inches per second. The nip rollers rotating at 897 rpm accelerate the sheet speed to 24 inches per second. The differential in peripheral speeds of these drive members is such that the sheet 40 is maintained in tension between the high friction material rotatable blocks 89 and the nip rollers 110 preventing buckling of the indexed sheet 40 as it leaves the dispenser 44 and while it is driven through the guide grooves 133 of the laterally opposed rails 48.

A further feature of the invention lies in the oblique positioning of the articulated roller assembly 99, with the arm 98 being positioned at an angle of approximately 30° to the horizontal to facilitate picking up the leading edge 140 of the indexed coated paper sheet, even if that leading edge curls downwardly. If there is extensive curling of the leading edge of the sheet as it is moved out of the dispenser 44 by the indexing rollers 88, the leading edge 140 of the sheet may first impinge on the belts 96 of the articulated roller assembly 99 and then move upward into the nip area between the nip rollers 110 and the pressure plate 122.

A further aspect of the present invention is the location of the articulated roller assembly 99. The nip rollers 110 are clearly to one side of the vertically driven food portion or meat patty 34 as it is forced out of the mold plate cavity 32 by the descending knockout cup 36 in the direction of food portion travel T, FIG. 1. Such is in high contrast to the prior art arrangements such as that exemplified by Wagner U.S. Pat. No. 5,137,172. There is a need to time the operation of the knockout cup to the horizontal travel of the mold plate 30 to a position where the food portion or meat patty 34 and cavity 32 are oriented coaxially with the knockout cup 36 prior to the downward drive of the knockout cup 36 against the food portion to forcibly knock out the food portion 34. As will be appreciated hereinafter, synchronization of the automatic sheet dispensing mechanism and the operation of the indexing roller 88 and the accelerating nip rollers 110 to the knockout of the food portion 34 by knockout cup 36 are such as to occur at the same instant at which the indexed and accelerated sheet 40 leading edge 140 impacts against the paper stop 132.

This is important since the thin flexible coated paper sheets 40 tend to droop at their centers into a concave configuration when in position beneath the food portion 34 and the opposite side edges may slip out of the guide slots or grooves 133 within laterally opposed rails 48. By synchronization of dispensing mechanism to that of the operation of the knockout cup 36, the instant of arrival of a sheet 40 oriented directly beneath the food portion 34, the knockout cup 36 drives the food portion 34 down travel path T. Upon leaving the mold cavity 32, the patty 34 impacts the upper surface of the indexed sheet 40 so as to drive sheet 40 downwardly in the direction of the stack 38 of food portions 34, with the food portion impaling the sheet. The sheet, so impaled, is forcibly driven in the direction of the arrow T onto the top of stack 38. With the meat patty or food portion 34 knocked out, at ejection station E.S., at the moment the indexed sheet 40 reaches its proper position centered beneath the knockout portion 34, impact of the meat patty with the upper face of the sheet is near instantaneous and there is no misalignment between the interleaved sheets 40 and the food portions 34 in the stack 38.

In order to position the sheet 40 at the correct time, it is necessary to synchronize the sheet dispensing mechanism 10 to the patty forming machine 14 to which it is attached. In the illustrated embodiment, this initiates the sheet indexing action by energizing an electrically operated single revolution clutch 130, causing the small diameter pulley 78 to be driven by shaft 76 so as to drive the high friction material blocks 89 at an initial peripheral velocity of approximately 22 inches per second. The electrical signal to energize clutch 130 is delivered by a line indicated by arrow 56 emanating from the solid state proximity switch 54. As stated previously, the proximity switch is set so that the clutch 130 is actuated at a point in the machine cycle that will cause the lower-most sheet 40 to be indexed into the nip of nip rollers 110 at the time that the food portion 34 is about to be driven downwardly from mold cavity 32 and to impact an underlying coated paper sheet 40 and drive it together with the food portion 34 onto the top of stack 38. In the illustrated embodiment, the illustrated sheet dispensing mechanism employs a shaft 76 on which the single revolution clutch 130 is mounted, which shaft is driven at 239 rpm. Shaft 76 is driven by auxiliary shaft 64, which also drives the nip rolls continuously. The single revolution clutch 130 does not operate by, nor is it connected to the articulated roller assembly 99. The nip rollers 110 are driven continuously and the timing system operates solely to initiate the contact of the rotatable friction blocks 89 against the bottom surface of the lower-most sheet 40 within the lock zone Z and to index a sheet 40 into a position where it enters the nip between the nip rollers 110 and the overlying pressure plate 122.

In the illustrated embodiment, the rotary motion that is required to drive the dispenser 44 is made available from a belt drive through power supply or drive belt 62 from shaft 58 of the transmission common to the hand-fed patty forming machine, which shaft 58 rotates it at 1078 rpm. Alternatively, the rotary motion for the dispenser may be supplied by a separate, small electric motor resulting in the dispenser 44 being independent of the hand fed patty forming machine 14 except for a switch input as from solid state proximity switch 54, or other patty forming machine cycle input signal to the single revolution clutch 130. In the operation of the single revolution clutch 130, the high friction material blocks 89 rotate from their initial at rest position shown in FIG. 1 through a single revolution for each electrical impulse 56 received from the proximity switch 54, with that operation returning the blocks 89 to the position shown in FIG. 1 after completing a counterclockwise rotation in accordance with arrow E. It should be understood that the description of a preferred embodiment is not limited to the food portion being a formed patty of meat, the invention has application to other molded food products or articles.

Further, while the invention has been described in terms of a specific embodiment, it should be understood that such embodiment is by way of illustration only and that the invention is not limited thereto. Modifications and variations will be apparent to those of ordinary skill in the art without departing from the spirit of this invention. Accordingly, such variations and modifications are expressed in the following claims.

We claim:

1. In a sheet dispensing mechanism for applying a separator sheet to each of a series of molded articles cyclically ejected at an ejection station along an article ejection path from a molding device for forming a stack of said articles, with said sheets interleaved therebetween, comprising:

an open bottom sheet dispenser positioned beside said path for retaining a stack of said sheets, with an end sheet of said stack exposed;

sheet feeding means operatively positioned adjacent said end sheet for feeding said end sheet from the bottom of said stack in the direction of said article travel path, said dispenser having at least laterally spaced sidewalls and a front wall facing in the direction of feed of said sheets, facing guides on opposite sidewalls of said dispenser engaged with respective opposite sides of said stacked sheets to guide said sheets and to provide a hold-back force tending to restrain said sheets against movement in the sheet feeding direction, said front wall terminating in a forward and downwardly oblique terminal portion forming with said facing guides a lock zone for a series of sheets at the bottom of the stack such that said sheets at the bottom of the stack shingle out against said oblique terminal portion of said front wall, the improvement wherein said sheet feeding means comprises at least one rotatable indexing roller mounted for rotation beneath said stack with a high coefficient of friction block member on a localized periphery of said roller, said friction block member penetrating said open bottom of said dispenser for pressing said shingled sheets against the bottom surface of said oblique terminal portion of said front wall, with said front wall oblique terminal portion functioning as a baffle to maintain all but said end sheet under pressure in said lock zone, but allowing said indexing roller to frictionally drive said end sheet in the direction of said path;

means responsive to movement of said molded article to said ejection station for indexing said at least one indexing roller through one revolution to cause said indexed end sheet of said stack to intersect said ejection path of said article simultaneously with ejection of said article such that the interleaving sheets are properly aligned with the articles during article stacking, while preventing said sheets from excessive sagging prior to impact of said article against said indexed end sheet during the stacking procedure.

2. The sheet dispensing mechanism as claimed in claim 1, further comprising a spring biased articulated nip roller assembly mounted downstream of said dispenser and said at least one rotatable indexing roller and being spaced therefrom and including at least one nip roller mounted for rotation about its axis for peripheral contact with said coated paper sheet indexed by said at least one indexing roller along said sheet feeding path, and a fixed stationary pressure plate coplanar with the path of travel of said indexed sheets and on a side opposite said at least one nip roller for contact therewith absent a sheet passing through the nip between the periphery of said at least one nip roller and said stationary pressure plate, and means for continuously driving said at least one nip roller at a peripheral speed in excess of the peripheral speed of the high friction block to maintain said sheet under tension when in contact with both of said rollers to prevent sheet buckling along said sheet feeding path and for accelerating said sheets downstream of a nip area between said at least one nip roller and said stationary pressure plate.

3. The sheet dispensing mechanism as claimed in claim 2, wherein said spring biased articulated nip roller assembly comprises an elongated arm having opposite proximal and distal ends relative to said sheet feed path, means for pivoting said distal end of said arm about a pivot axis at right angles to said sheet feeding path remote from said sheet feeding path, means for mounting said at least one nip roller for rotation about its axis on the proximate end of said arm, with the periphery of the nip roller generally parallel to the plane of the stationary pressure plate, means for pivotably mounting the distal end of said arm in a position such that said arm is oblique to the pressure plate in the direction of sheet feeding to facilitate nip roller pickup of the leading edge of the sheet if this sheet is curled downwardly upon exiting of the nip area between the at least one indexing roller and the pressure plate, thereby causing the leading edge of the indexed sheet to enter said nip area.

4. The sheet dispensing mechanism as claimed in claim 3, wherein said at least one nip roller comprises two nip rollers on opposite sides of said arm, fixedly mounted to a shaft projecting through the proximate end of said arm for rotation about axes parallel to the plane of the pressure plate, said arm being sectioned transversely between its opposite ends, and means for swiveling one section of said arm relative to the other section about a longitudinal axis of the elongated arm, whereby said nip rollers apply substantially equal pressure on the indexed sheet moving between the pair of nip rollers and the pressure plate to prevent skewing of the indexed sheet during acceleration of the sheet through the articulated nip roller assembly.

5. The sheet dispensing mechanism as claimed in claim 4, wherein said swiveling means comprises a pivot pin extending longitudinally between the two sections of said arm along the longitudinal axis of the arm and being journaled to one of said two sections.

6. The sheet dispensing mechanism as claimed in claim 3, wherein said means for continuously driving said at least one nip roller comprises a pulley and belt drive system mounted to said arm with pulleys at opposite ends of said arm, a drive belt trained over said pulleys and having belt runs extending parallel to the longitudinal axis of said arm intermediate of the ends of said arm, whereby exterior surfaces of the belt facilitate picking the leading edge of said indexed sheets, thereby moving said leading edge of said sheet into the nip area between said at least one nip roller and said stationary pressure plate.

7. The sheet dispensing mechanism as claimed in claim 6, wherein said spring biased nip roller assembly comprises a lever fixed to a side of said arm proximate to the distal end of the arm, a cylinder fixedly mounted to said frame and interposed between said frame and said lever, said cylinder including a compression coil spring internally thereof about a projectable plunger and tending to bias the plunger in the direction of said lever for impingement against the lever so as to exert a biasing force on said lever tending to rotate said arm about said distal end pivot axis and further tending to bias the at least one nip roller into contact with the lowermost paper sheet of said stack upon indexing of the same in the direction of the article ejection path downstream of at least one nip roller.

8. The sheet dispensing mechanism as claimed in claim 7, wherein said sheets comprise thin flexible coated paper sheets such that a force is developed by said spring loaded lever driven arm on which said at least one nip roller is mounted such that the normal force at the point of peripheral contact with said sheet is on the order of nine ounces which is adequate to accelerate the sheet in the direction of the article ejection path, the force also being less than that causing undesirable wear on said at least one nip roller when said at least one nip roller is in contact with the pressure plate absent contact with a dispensed sheet being indexed into the nip area between the at least one nip roller and the pressure plate.

9. The sheet dispensing mechanism as claimed in claim 8, wherein a pair of laterally spaced rails are interposed horizontally between the dispenser at the bottom of the dispenser and in line therewith through the ejected food portion path from the molding plate of the patty forming machine to said stack of food portions with interleaved coated paper sheets therebetween, and wherein a paper stop is interposed between said laterally spaced rails in the path of travel of said coated paper sheet to the side of said article ejection path opposite that of said articulated nip roller assembly for accurately positioning said indexed and accelerated coated paper sheet in alignment with the article election path, and wherein said rails include notches within upper surfaces thereof, the notches being downstream of said at least one nip roller and being sized to the length of said coated paper sheets such that a trailing edge of each sheet falls by gravity into said notches at the moment of impact of the coated paper sheet leading edge with the paper stop to prevent rebound of said coated paper sheet and thereby ensure proper positioning of the coated paper sheet on the article ejection path.

10. The sheet dispensing mechanism as claimed in claim 9, further comprising a pair of guide grooves within opposing faces of said laterally spaced rails aligned horizontally with the nip area between said at least one nip roller and said pressure plate and downstream thereof and extending from said pressure plate to said paper stop for guiding the lateral side edges of said paper sheets during accelerated movement from the articulated nip roller assembly towards the paper stop and for supporting the sides of said paper coated sheets momentarily, prior to impact of the leading edge against said stop.

11. The sheet dispensing mechanism as claimed in claim 3, wherein said drive means for rotating said at least one indexing roller and said at least one nip roller about their axes in a common sheet feeding direction comprises: a drive motor, a first drive train connecting said drive motor to said at least one nip roller for continuously driving said at least one nip roller, a second drive train connecting said drive motor to said at least one indexing roller and including an electrical pulse operated single revolution clutch, and a proximity switch responsive to cyclic movement of said oscillating mold plate from a first mold cavity molded article filling position to a second molded article ejection position at said molded article ejection station for momentarily electrical pulse energization of said single revolution clutch to cause said at least one indexing roller to index a lowermost coated paper sheet from said dispenser to the nip area between said continuously driven at least one nip roller and said stationary pressure plate.

* * * * *